US005340232A

United States Patent [19]

Spiess et al.

[11] Patent Number: 5,340,232

[45] Date of Patent: Aug. 23, 1994

[54] MANHOLE COVER

[75] Inventors: Hansruedi Spiess, Delémont; Francois Galvanetto, Alle, both of Switzerland

[73] Assignee: Von Roll AG, Gerlafingen, Switzerland

[21] Appl. No.: 651,400

[22] PCT Filed: Jun. 18, 1990

[86] PCT No.: PCT/CH90/00148

§ 371 Date: Apr. 17, 1991

§ 102(e) Date: Apr. 17, 1991

[87] PCT Pub. No.: WO91/00942

PCT Pub. Date: Jan. 24, 1991

[30] Foreign Application Priority Data

Jul. 11, 1989 [CH] Switzerland ..... 2584/89-9

[51] Int. Cl.[5] ..... E05C 19/06

[52] U.S. Cl. ..... 404/25; 49/465

[58] Field of Search ..... 404/25, 26; 52/20; 49/465

[56] References Cited

U.S. PATENT DOCUMENTS 4,570,399 2/1986 Wentink ..... 49/465 X 5,071,177 12/1991 Spiess et al. ..... 404/25 X

FOREIGN PATENT DOCUMENTS 317919 5/1989 European Pat. Off. ..... 404/25

47912 12/1979 U.S.S.R. ..... 404/25

*Primary Examiner*—William P. Neuder

*Attorney, Agent, or Firm*—Egli International

[57] ABSTRACT

The invention concerns a manhole cover with a frame (1) and a grating (3) or cover fitting flush with the frame (1). In order to secure the cover (3) in such a way that it can be easily removed and put back in place, a one-piece securing element (4*a*) is attached to the frame (1), the securing element (4*a*) having a locking element (7) at the end of a tab-like retaining element (6) extending obliquely upwards. The locking element (7) engages against a locking surface (9) at the bottom of a recess (8) in the surface of the grating (3) or cover. To unlock the manhole cover, the locking element (7) can be pulled away from the locking surface (9) with a special tool, e.g. a pair of pliers, the retaining element (6) being bent elastically. The securing element (4*a*) is mounted on the frame (1), embracing shoulders (5*a*, 5*b*) so that it is secured by a snap-in connection. The securing element can also be attached to the cover or grating and engage against a locking surface on the frame.

21 Claims, 6 Drawing Sheets

MANHOLE COVER

The invention relates to a manhole cover which comprises a frame anchored in the ground and having a lower-lying supporting shoulder at least partially surrounding the frame aperture, and a grating or cover resting on said shoulder and fitting flush with the frame aperture.

Manhole covers of this kind must be secured in such a way that the grating or cover cannot jump out of the frame due to the action of vehicles driving over the top and, as far as possible, also in such a way that they cannot be removed by unauthorised persons. In a known solution, grating and frame are screwed together.

It is the object of the invention to indicate a manhole cover of the generic type with a securing device which allows the grating or cover to be fitted and removed as easily as possible.

The invention, as characterised in the claims, creates a manhole cover in which the grating or cover is secured automatically when fitted, without the necessity for an additional operation. Removal is equally simple, it being easy to design the manhole cover in such a way that the grating or cover can be removed only by means of a special tool, but easily and rapidly with it.

Further advantages of the invention consist, in particular, in the fact that the frame can be simpler in design than if a screwed connection were provided, and in the simplification of the production of the frame and of the grating or cover, since the drilling of holes and tapping of threads is superfluous and operations are thus omitted.

Figure 1A:
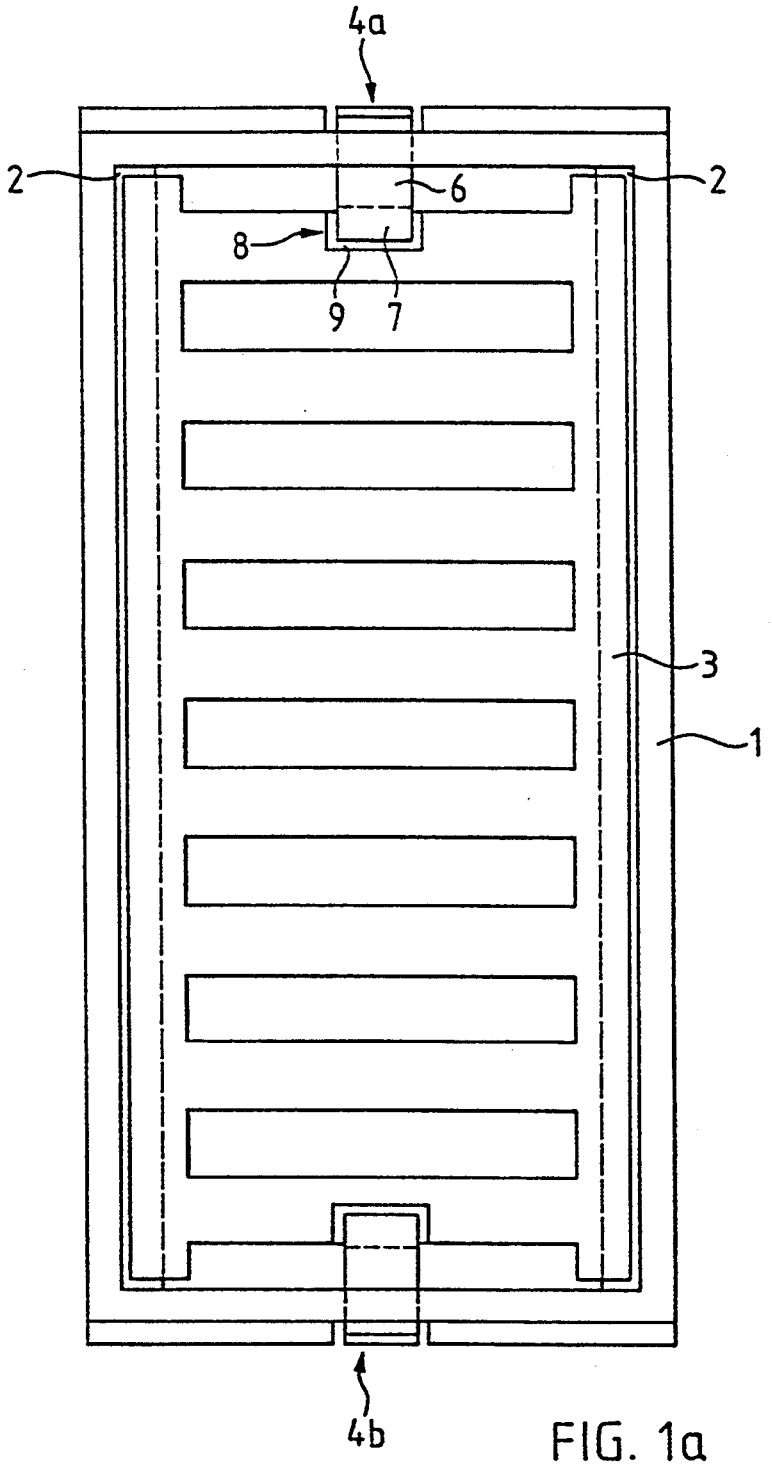
Figure 1B:
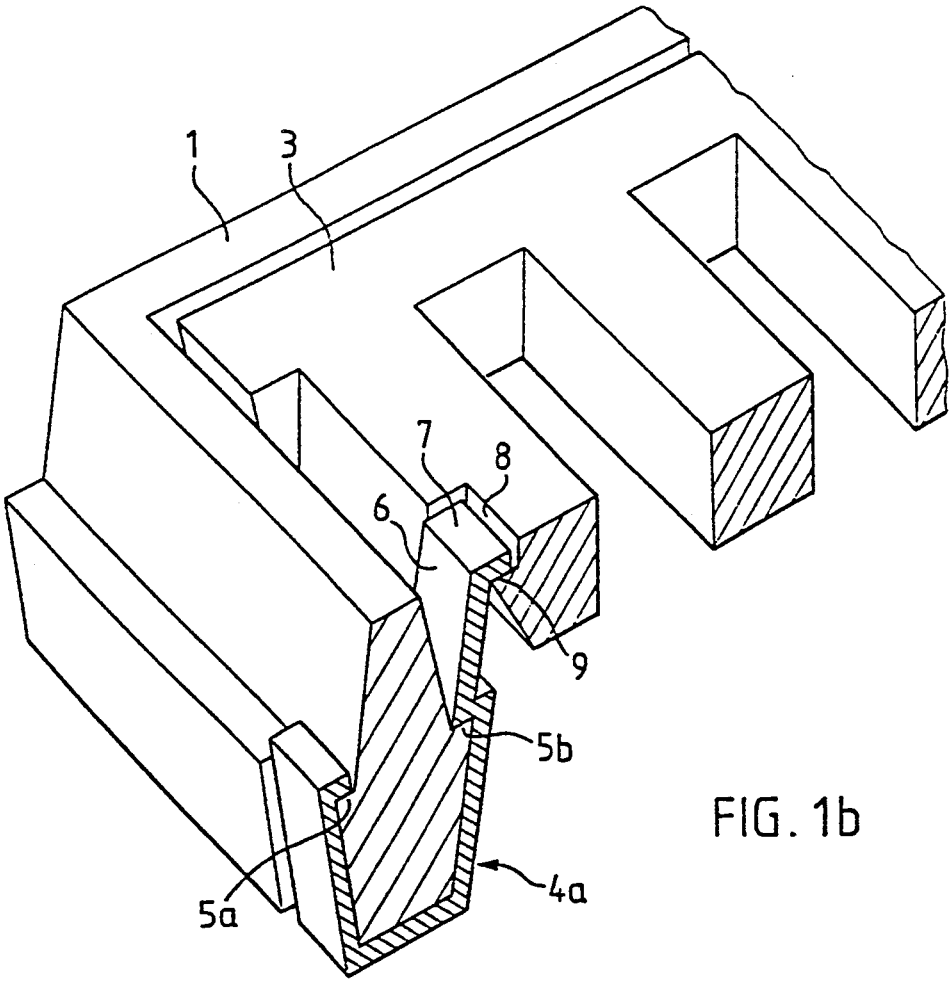
Figure 2A:
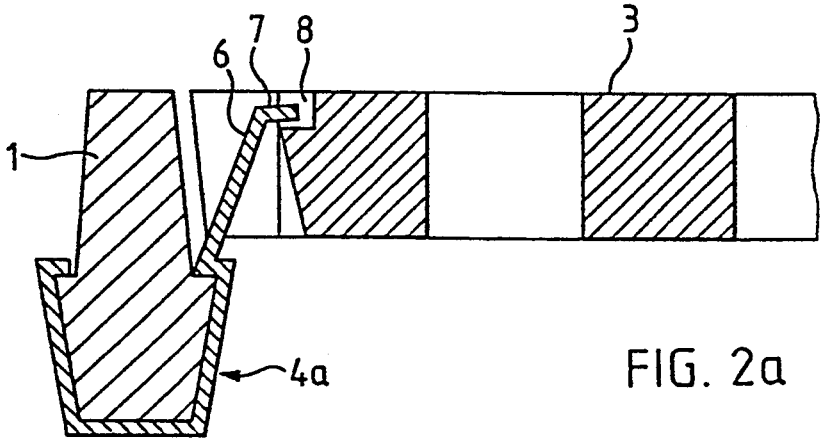
Figure 2B:
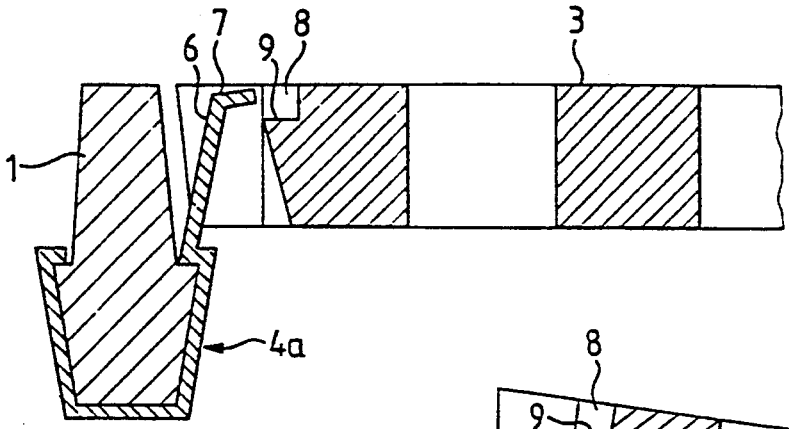
Figure 2C:
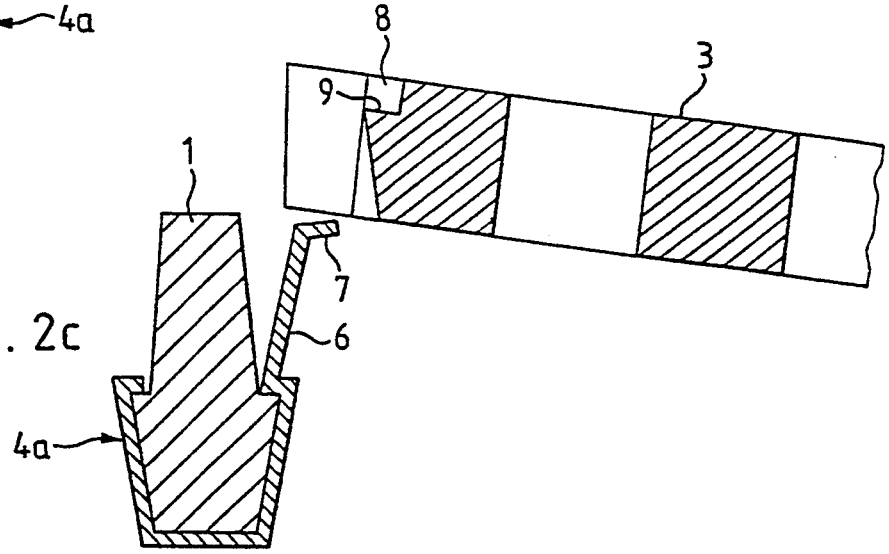
Figure 3:
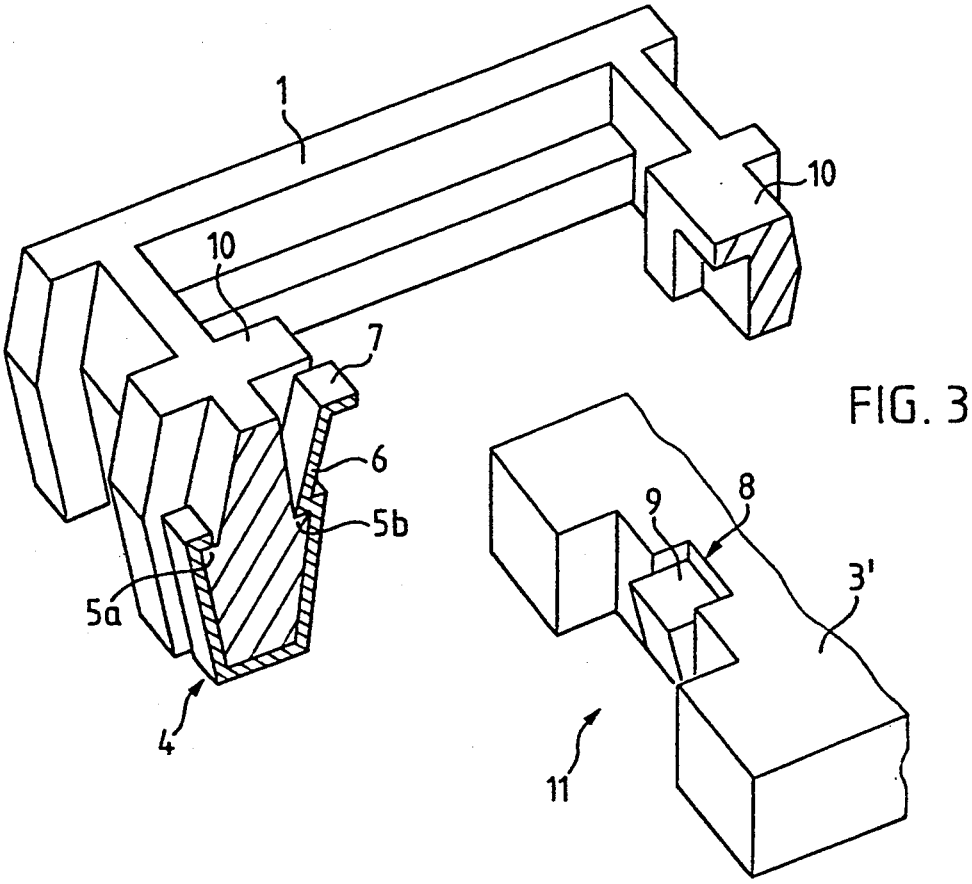
Figure 4:
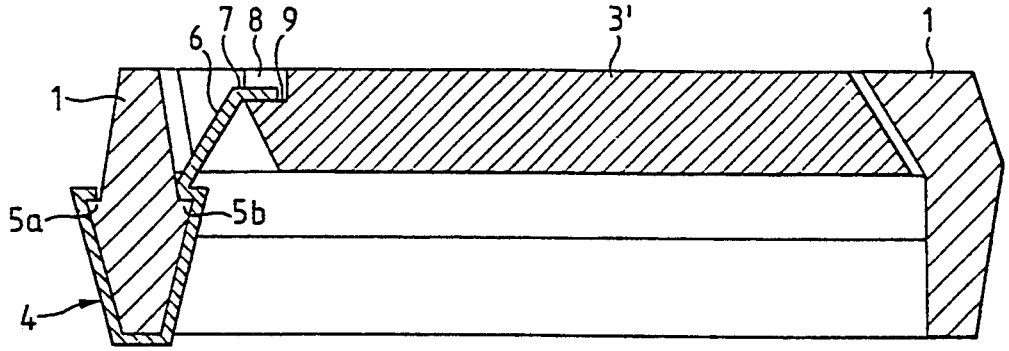
Figure 5A:
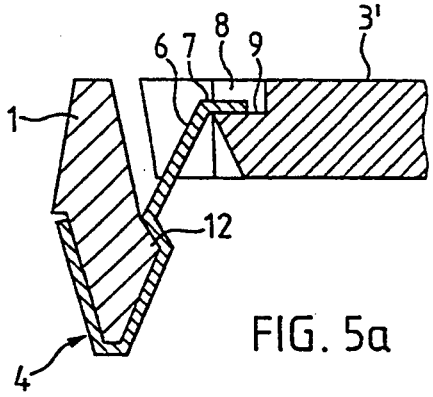
Figure 5B:
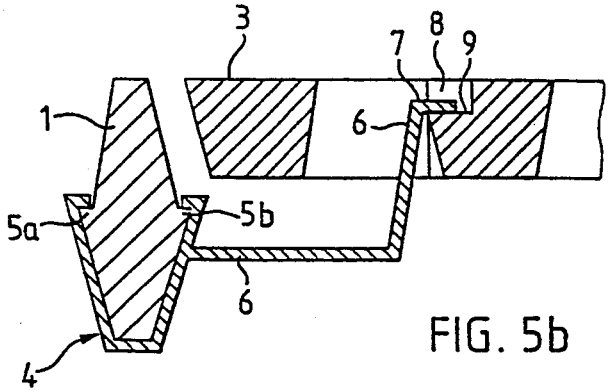
Figure 5C:
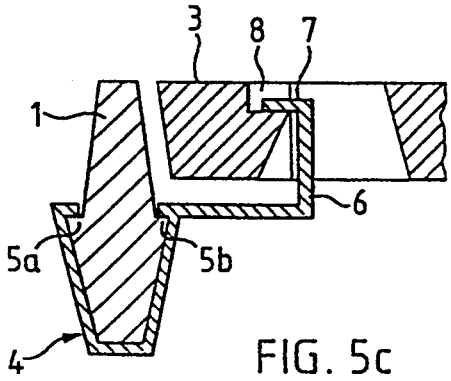
Figure 5D:
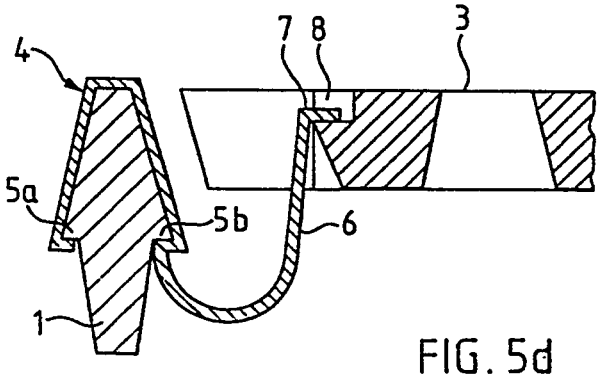
Figure 5E:
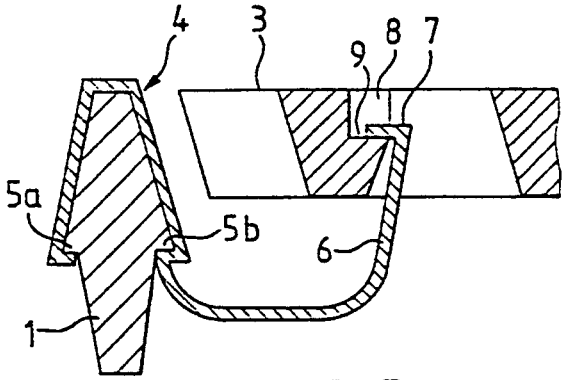
Figure 5F:
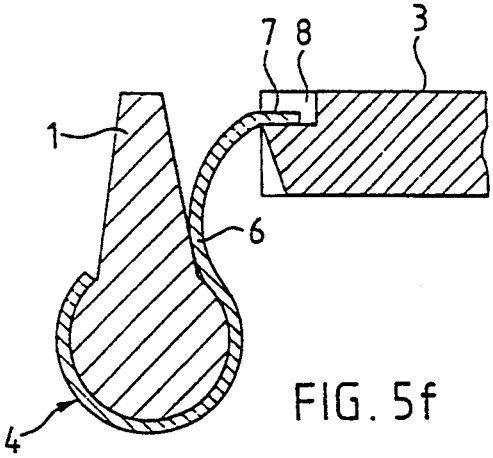
Figure 6A:
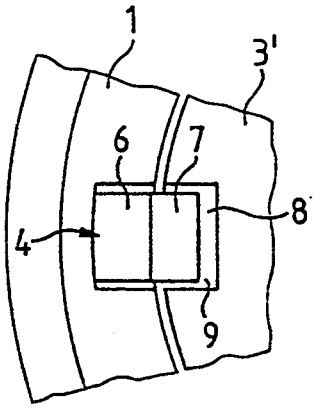
Figure 6B:
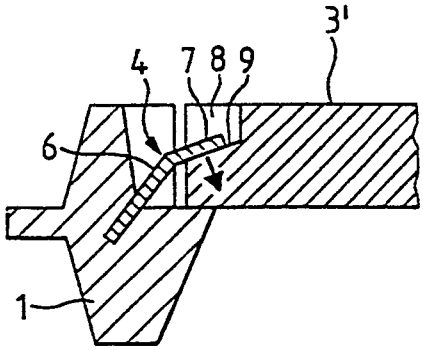
Figure 7:
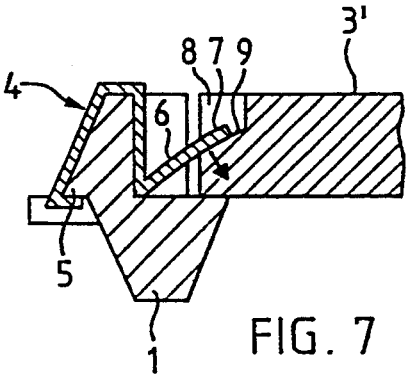
Figure 8:
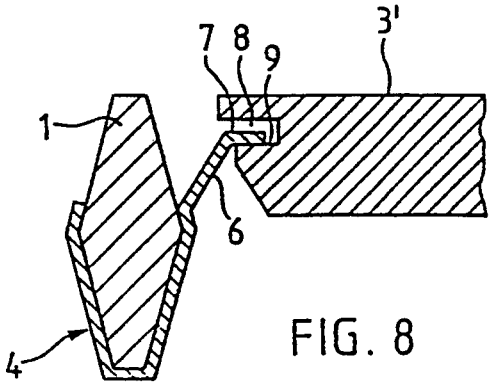
Figure 9:
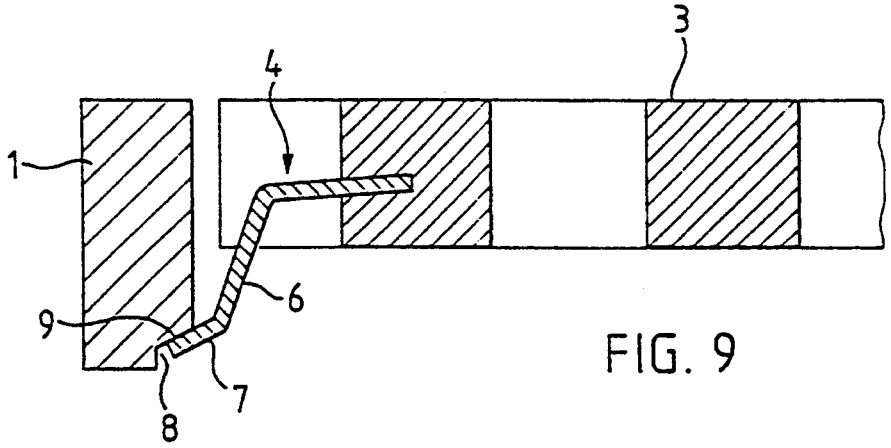
Figure 10:
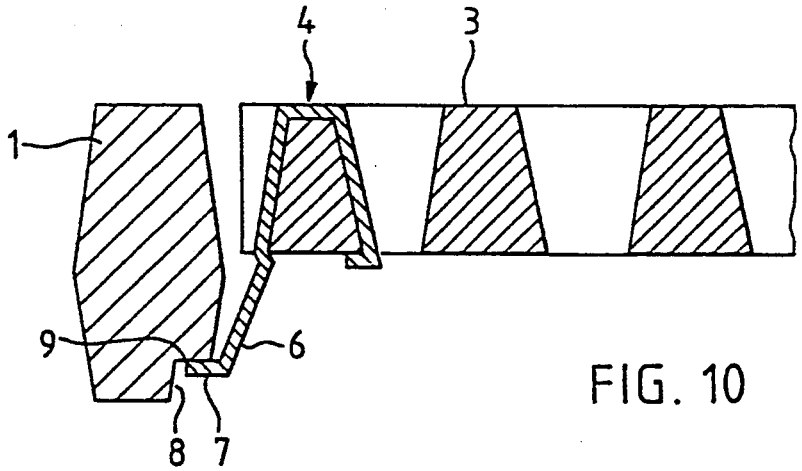

The invention is explained in greater detail below with reference to Figures which represent only embodiments:

FIG. 1*a* shows a plan view of a first manhole cover according to the invention, FIG. 1*b* shows a sectioned perspective representation of the manhole cover according to FIG. 1*a*, FIGS. 2*a–c* show the opening of the manhole cover according to FIGS. 1*a*, 1*b*, in section, FIG. 3 shows a second manhole cover according to the invention, in perspective, FIG. 4 shows a further manhole cover according to the invention, in section, FIGS. 5*a–f* show securing elements and their anchoring on the frame in the case of various manhole covers according to the invention, in section, FIGS. 6*a,b* show a further manhole cover according to the invention, FIG. 7 shows a variant of the manhole cover according to FIGS. 6*a,b*, in section, FIG. 8 shows a further manhole cover according to the invention, in section, FIG. 9 shows a manhole cover according to the invention with a securing element attached to the grating, in section, and FIG. 10 shows a variant of the manhole cover according to FIG. 9, likewise in section.

The manhole cover depicted in FIGS. 1*a*, 1*b* has a frame 1 with a two-part, lower-lying supporting shoulder 2, on which a grating 3 rests.

According to the invention, two securing elements 4*a,b* arranged diametrically opposite to one another are attached to the frame. They are preferably of one-piece spring-steel construction and mounted on the frame 1.

The securing element 4*a* here fits over the top of shoulders 5*a,b* on both sides, thus producing a snap-in connection which secures it on the frame 1. The securing element 4*a* comprises a retaining element 6, which is designed as a resilient tab extending obliquely upwards and adjoining which is a locking element 7. On its upper surface, the grating 3 has a recess 8, the base of which is formed by a locking surface 9. The locking element 7 and the locking surface 9 are in engagement with one another and in this way secure the grating 3. The second securing element 4*b* is preferably of identical design to the first locking element 4*a* but can also be replaced by some other device, e.g. by a projection on the frame which engages in a recess on the surface of the grating (for further possibilities see below).

Suitable materials for securing elements are, in particular, metallic materials, in particular spring steel and other steel grades or cast iron containing spheroidal graphite, as well as corrosion-resistant plastics.

As depicted in FIGS. 2*a–c*, the manhole cover is unlocked by pulling back the locking element 7 from the locking surface 9, the retention part 6 being elastically deformed. The grating 3 can then simply be lifted off. To prevent theft, it is advantageous to design the securing element 4*a* and, in particular, to dimension the retaining element 6 in such a way that a deformation sufficient for the unlocking of the grating 3 is only possible using a special tool, e.g. a pair of pliers applied to the end of the locking element 7 and supported against the frame 1.

The mounting of the grating is facilitated by the fact that it is chamfered somewhat at the bottom. As soon as it has reached the closure position, the lock snaps in automatically.

FIG. 3 shows a manhole cover according to the invention in which a cover 3' can be fitted positively into the frame 1—projections 10 on the frame 1 engaging in recesses 11 on the cover 3'—in such a way that a single securing element 4 is sufficient. The latter is here flanked by projections 10 and thereby especially protected.

FIG. 4 shows a manhole cover according to the invention likewise having only one securing element 4, which is of identical design to the manhole covers already described. Diametrically opposite the securing element 4, the edge of the cover 3' is chamfered and projects under a correspondingly chamfered overhanging edge part of the frame 1, with the result that the cover 3' is also locked there.

FIGS. 5*a–f* show various possibilities for the design of the securing elements 4 and their anchoring on the frame 1. In the embodiment according to FIG. 5*a*, the securing element 4 is particularly easy to mount and remove since the shoulders of the embodiments described above are absent. The securing element 4 is nevertheless adequately secured by the projecting edge 12, over which the securing element 4 engages.

In the case of the securing elements according to FIGS. 5*b–e*, release is made easier in comparison with the embodiments described above, because of the greater length of the retaining element 6 in combination with the same cross-section of the latter. The embodiments according to FIGS. 5*d,e* have the advantage that the securing element 4 can in each case be mounted on the frame 1 from above, i.e. it can readily be mounted subsequently and exchanged more easily.

In the case of the securing element according to FIG. 5*f*, engagement over angular shoulders or projections is avoided, facilitating its fitting and removal. Since the securing element 4 cannot be removed without considerable elastic deformation, it is nevertheless reliably secured on the frame 1.

FIGS. 6*a,b* show a manhole cover according to the invention which can also be of sealing design. The securing element 4 is embedded in the frame 1. As indicated by an arrow, the locking element 7 presses with a residual stress against the locking surface 9, which is inclined towards the edge of the recess 8 for the purpose of easier unlocking. The cover 3' is thus pressed against the frame 1.

FIG. 7 shows a variant of the embodiment according to FIGS. 6*a,b* with a securing element 4 mounted with engagement over a shoulder 5.

FIG. 8 depicts a manhole cover according to the invention in which the recess 8 is formed on the side of the cover 3' and is limited towards the top. In this embodiment, access to the securing element 4 without special tools is made more difficult and particularly effective protection against theft is provided.

FIG. 9 shows an embodiment in which the securing element 4 is embedded in the grating 3 and its retaining element 6 is designed as a resilient tab extending obliquely downwards. The locking element 7 is in engagement with a locking surface 9 in a recess 8 on the underside of the frame 1.

Finally, FIG. 10 shows a variant of the embodiment according to FIG. 9 in which the securing element 4 is mounted on the grating 3 and locked by means of snapping in. In this embodiment, the securing element 4 can be removed very easily after the removal of the grating 3.

We claim:

1. A manhole cover which comprises:

(a) a frame having a lower-lying supporting shoulder at least partially surrounding the frame;

(b) a cover dimensioned and configured to receive into the frame; and (c) a securing element dimensioned and configured to maintain the cover with the frame, the securing element including:

(i) a resilient portion extending from the frame; and (ii) an engaging portion depending from the resilient portion for releasibly engaging the cover to inhibit relative movement of the cover from the frame.

2. A manhole cover as recited in claim 11, wherein said cover is configures as a grating configuration.

3. A manhole cover comprising:

(a) a frame defining a frame aperture, said frame anchored in the ground and having a lower-lying supporting shoulder at least partially surrounding the frame aperture;

(b) a grating resting on said supporting shoulder and fitting flush with said frame aperture, said grating defining a locking surface;

(c) at least one securing element being attached to said frame by a snap-in arrangement for securing said grating to said frame, said at least one securing element comprising:

(i) a resilient retaining element defining a locking element extending therefrom, said locking element being dimensioned and configured so as to detachably engage with said locking surface of said grating such that said locking element disengages with said locking surface upon elastic deformation of said resilient retaining element.

4. A manhole cover as recited in claim 3, wherein said locking surface forms the base of a recess on said grating in which said locking element engages.

5. A manhole cover as recited in claim 4, wherein said recess is formed on an upper surface of said grating and said retaining element is designed as a resilient tab extending obliquely upwards or downwards.

6. A manhole cover comprising:

(a) a frame defining a frame aperture, said frame anchored in the ground and having a lower-lying supporting shoulder at least partially surrounding the frame aperture;

(b) a cover resting on said supporting shoulder and fitting flush with said frame aperture, said cover defining a locking surface;

(c) at least one securing element being attached to said frame by a snap-in arrangement for securing said cover to said frame, said at least one securing element comprising:

(i) a resilient retaining element defining a locking element extending therefrom, said locking element being dimensioned and configured so as to detachably engage with said locking surface of said cover such that said locking element disengages with said locking surface upon elastic deformation of said resilient retaining element.

7. A manhole cover as recited in claim 6, wherein said locking surface forms the base of a recess on said cover in which said locking element engages.

8. A manhole cover comprising:

a frame anchored in the ground and having a lower-lying supporting shoulder at least partially surrounding the frame aperture, a grating or cover fitting flush with the frame aperture, said grating or cover defining a locking surface, at lest one securing element attached to the frame by a snap-in arrangement for detachably securing the cover in the frame, said securing element comprising:

a resilient retaining element and a locking element extending from the retaining element and engaging the locking surface on the grating or cover, from which it can be pulled back by elastic deformation of the retaining element.

9. A manhole cover according to claim 8, wherein the locking surface forms the base of a recess on the grating or cover in which the locking element engages.

10. A manhole cover according to claim 9, wherein the recess is formed on the upper surface of the grating or cover and the retaining element is designed as a resilient tab extending obliquely upwards.

11. A manhole cover according to claim 9, wherein the recess is formed on the side of the grating or cover and is limited towards the top.

12. A manhole cover according to claim 9, wherein the locking surface is inclined towards the edge of the recess.

13. A manhole cover according to claim 8, with the retaining element pressing the locking element with a residual stress against the locking surface.

14. A manhole cover according to claim 8, wherein the retaining element is manufactured in one piece from a metallic material.

15. A manhole cover according to claim 14, wherein the metallic material is steel or spheroidal graphite.

16. A manhole cover according to claim 8, wherein the retaining element manufactured in one piece from plastic.

17. A manhole cover comprising:

a frame anchored in the ground and having a lower-lying supporting shoulder at least partially surrounding the frame aperture, said frame defining a locking surface, a grating or cover fitting flush with the frame aperture, at least one securing element attached to the grating or cover by a snap-in arrangement for detachably securing the cover in the frame, said securing element comprising:

a resilient retaining element and a locking element extending from the retaining element and engaging the locking surface on the frame, from which it can be pulled back by elastic deformation of the retaining element.

18. A manhole cover according to claim 17, wherein the locking surface forms the base of a recess on the frame in which the locking element engages.

19. A manhole cover according to claim 18, wherein the recess is formed on the underside of the frame and the retaining element is designed as a resilient tab extending obliquely downwards.

20. A manhole cover according to claim 18, wherein the locking surface inclined towards the edge of the recess.

21. A manhole cover according to claim 17, wherein the retaining element pressing the locking element with a residual stress against the locking surface.

* * * * *